United States Patent [19]

Kaelin et al.

[11] 3,940,880

[45] Mar. 2, 1976

[54] DOLL JOINT STRUCTURES

[75] Inventors: Bette M. Kaelin; Rouben T. Terzian, both of Chicago, Ill.

[73] Assignee: Marvin Glass & Associates, Chicago, Ill.

[22] Filed: Feb. 13, 1975

[21] Appl. No.: 549,755

[52] U.S. Cl. ..... 46/161; 46/173

[51] Int. Cl.[2] ..... A63H 3/46

[58] Field of Search ..... 46/161, 173

[56] References Cited

UNITED STATES PATENTS

| | | | |
|---|---|---|---|
| 3,477,171 | 11/1969 | Bonnano | 46/161 |
| 3,537,209 | 11/1970 | Boggart et al. | 46/161 |
| 3,706,155 | 12/1972 | Balza | 46/161 |
| 3,816,957 | 6/1974 | Nakajima | 46/173 |

*Primary Examiner*—Louis G. Mancene
*Assistant Examiner*—Robert F. Cutting
*Attorney, Agent, or Firm*—Coffee & Sweeney

[57] ABSTRACT

A doll joint structure for connecting the limbs of a toy figure or doll to the torso. A first toy figure part has a generally concave socket portion having an opening therethrough. A second toy figure part has a complementary convex portion at said joint for engagement within the concave portion of the first part. A resiliently flexible intermediate connecting member is disposed between the two figure parts at the joint. The intermediate connecting member is sort of mushroom shaped and includes an elongated shaft portion on one end fixedly positioned in the opening in the first figure toy part, and a generally disc-shaped flange portion at the other end for fixed engagement with the second figure toy part. The disc-shaped flange portion of the connecting member includes a cylindrical flange therearound to provide greater area of contact between the connecting member and the second toy figure part. The flange portion of the connecting member is resiliently flexible so that as the limb of the doll or figure toy is moved the flange portion will flex to accommodate the movement and, upon release of the limb, return the limb back to its original position.

13 Claims, 8 Drawing Figures

Fig 1
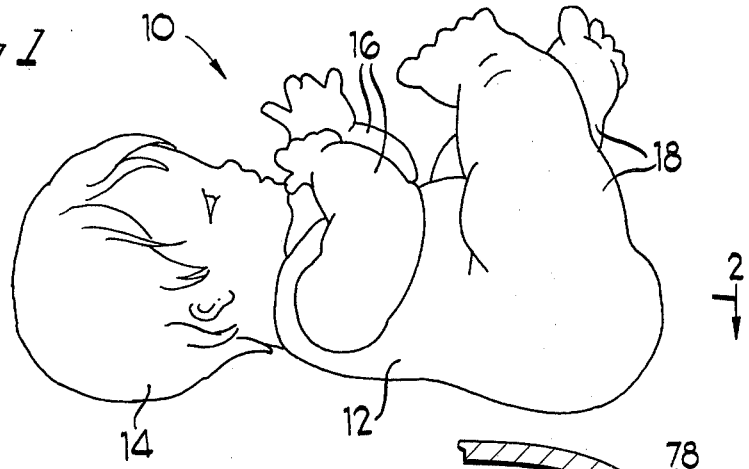
Fig 3
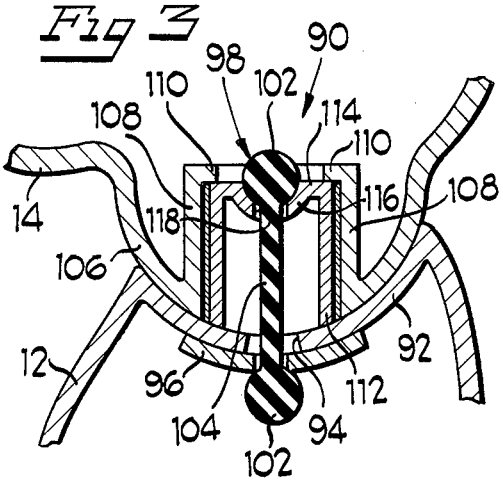
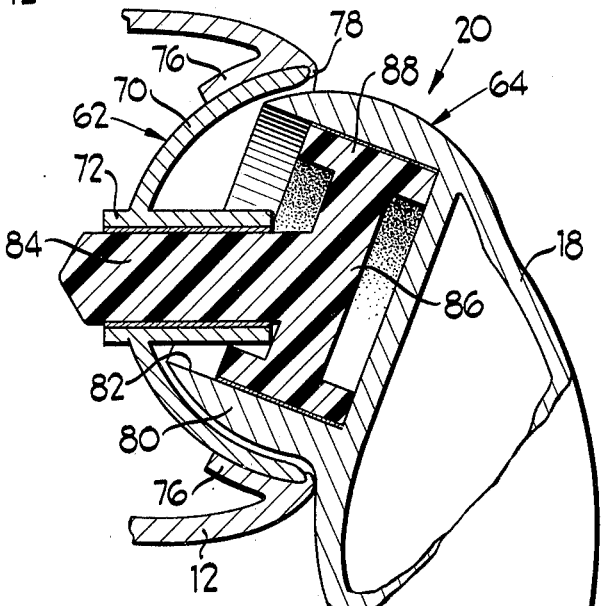
Fig 5
Fig 4
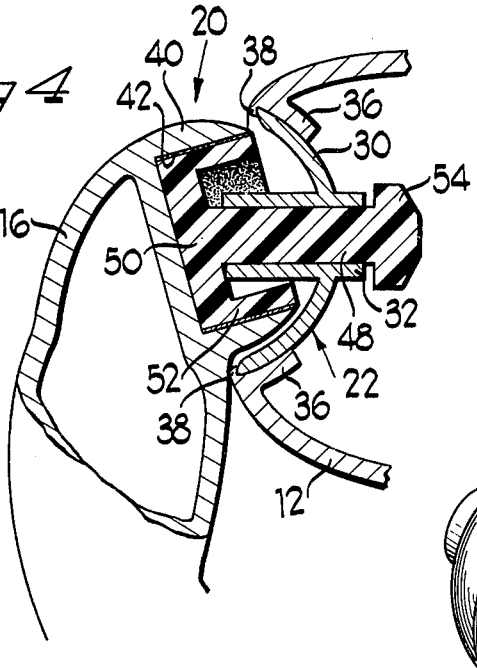
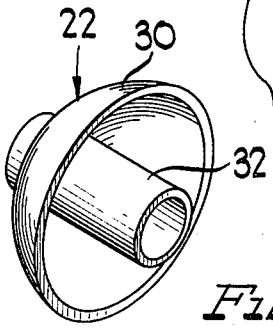
Fig 6

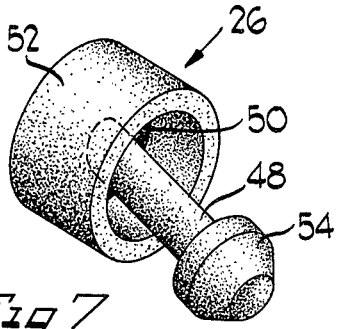
Fig 7
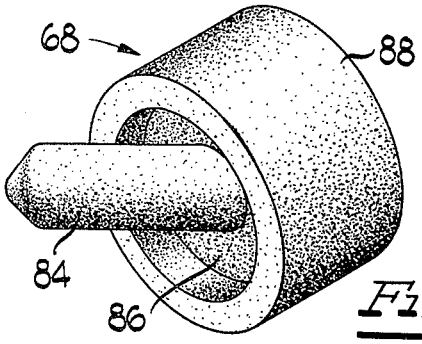
Fig 8
Fig 2
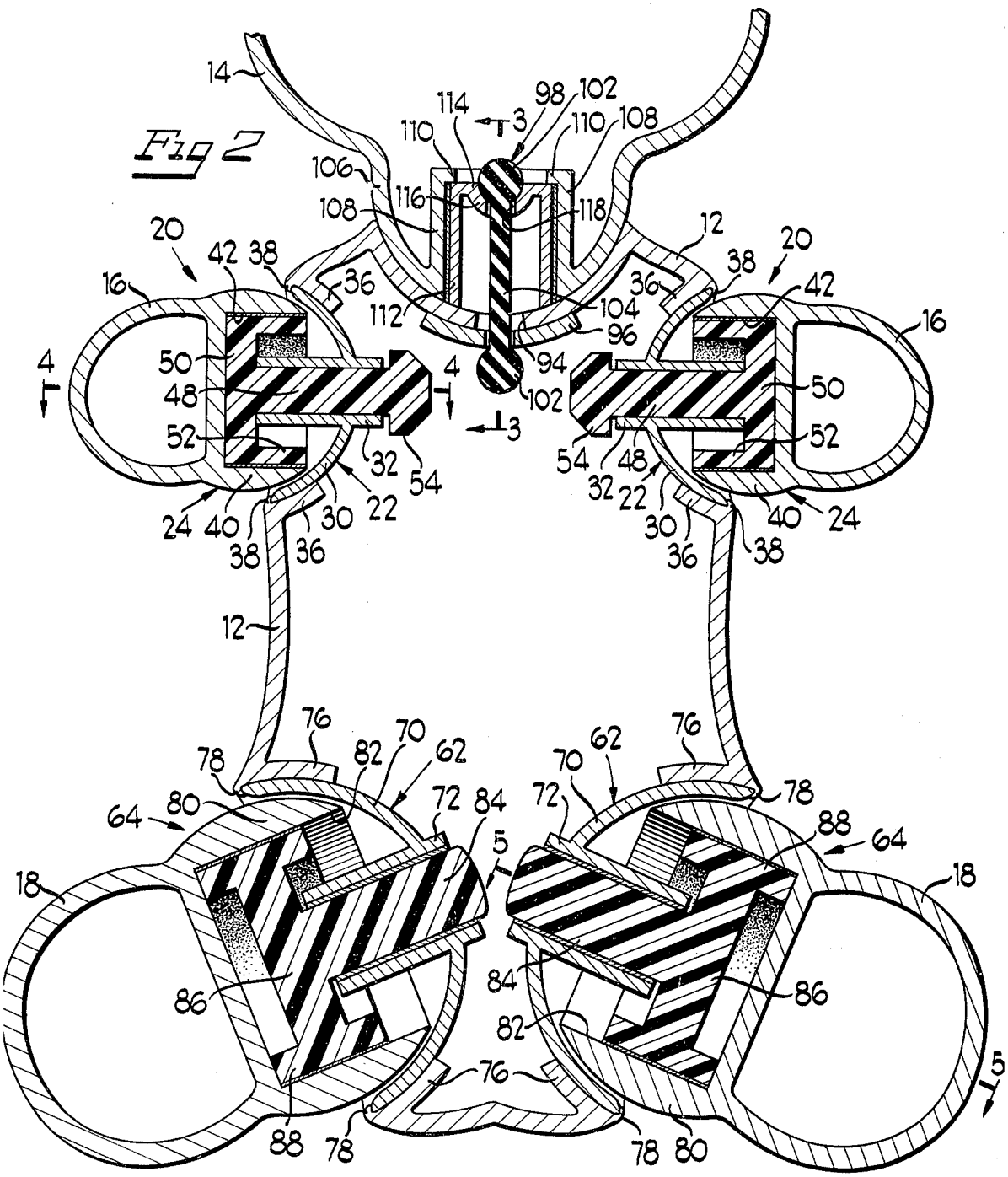

DOLL JOINT STRUCTURES

BACKGROUND AND SUMMARY OF THE INVENTION

This invention relates to toy figures, mannekins, jointed dolls, and the like. Particularly, the invention is directed to providing a joint structure of the character described, with new and improved joint means to permit articulation of the several limbs of the toy figure or doll.

Heretofore, joint structures of toy figures, such as dolls or the like, usually took the form of a ball and socket-type joint with resilient means, such as a spring, holding the ball portion of one figure member in the socket portion of another figure member in various articulated positions. Dolls or figure toys provided with a ball and socket-type joint at the limbs normally required additional manual manipulation of the limbs to return them to their original position.

An object of the present invention is to provide a new and improved joint structure for connecting limbs of figure toys, such as dolls or the like, which will maintain the limbs in a predetermined relative position, permit articulated movement away from that position, and return the limbs to the predetermined position after they have been moved and released by a child or other user.

Although the joint structure of the present invention is adapted for all sorts of toy figures, mannekins, and the like, it is shown herein in a baby doll construction.

In the exemplary embodiment of the present invention, the joint structure for connecting the limbs of the doll includes a first toy figure part having a generally concave socket-type portion at the joint. A second toy figure part has a generally complementary convex portion at the joint for engagement within the concave portion of the first part. An intermediate connecting member is disposed between the first and second toy figure parts of the doll, between the relative concave and convex portions thereof. The intermediate member is resiliently flexible and is somewhat mushroom shaped, including an elongated shaft portion which is fixed within an opening in the concave portion of the first toy figure part. A disc-shaped flange portion is formed at the other end of the shaft and a circumscribing cylindrical flange portion surrounds the disc-shaped flange portion for securement to the inside of the convex portion of the second toy figure part. The joint structure is shown herein in opposite orientations in the upper torso portion between the doll's arms and the upper torso portion, and in the hip joints between the lower torso portion and the doll's legs. Of course, other joint areas where the joint structure could be used also are contemplated.

Other objects, features and advantages of the invention will be apparent from the following detailed description taken in connection with the accompanying drawings.

BRIEF DESCRIPTION OF THE DRAWINGS

FIG. 1 is a perspective view of a toy figure in the form of a doll in a lying down position, incorporating joint structures of the present invention between the torso and the limbs;

FIG. 2 is a section of the doll of FIG. 1, on an enlarged scale, taken generally along the line 2—2 of FIG. 1, but in an upright position to facilitate the illustration of the various joint structures of the doll;

FIG. 3 is a fragmented vertical section, taken generally along the line 3—3 of FIG, 2;

FIG. 4 is a fragmented horizontal section, taken generally along the line 4—4 of FIG. 2;

FIG. 5 is a canted section taken generally along the line 5—5 of FIG. 2;

FIG. 6 is a perspective view of one of the concave joint portions;

FIG. 7 is a perspective view of the intermediate connecting member in the arm joints of the doll; and FIG. 8 is a perspective view of the intermediate connecting member for the leg joints of the doll.

DESCRIPTION OF THE PREFERRED EMBODIMENT

A doll, generally designated 10, employing the use of several of the joint structures of the present invention is shown in FIG. 1. The doll includes a body or torso portion 12, a head 14, a pair of arms 16 and a pair of legs 18. FIG. 1 shows the doll 10 in a lying down position with its arms and legs extending generally upwardly as is not uncommon or even normal with infants before they are able to sit or stand. However, the doll 10 is capable of supporting itself in a sitting position, as shown in FIG. 2.

Joint structures, generally designated 20 in FIGS. 2, 4 and 5, maintain the arms and legs in the aforesaid normal position. Both the arms 16 and the legs are flexibly mounted by the joint structures 20 so that they may be manually moved to different positions, but will return and assume the position as shown in FIG. 1 after they are released. Additionally, the arms 16 are rotatably mounted to the torso 12 so that they may be pivoted about a rotational axis through the shoulder areas while maintaining the same shape and form relative to the joint structure when free of outside forces.

Referring to the top of FIG. 2 and to FIGS. 4, 6 and 7, each of the joint structures 20 between the arms 16 and the torso 12 includes a generally concave toy figure apart, generally designated 22 (see FIG. 6), disposed in the limb sockets of the torso 12, a second generally convex toy figure part, generally designated 24 (FIG. 2), formed integrally with the arms and intermediate member, generally designated 26 (FIG. 7).

More particularly, the first toy figure part 22 (FIG. 6) is secured to the torso 12 to maintain and secure the arms 16 to the torso 12. Each first toy figure part 22 includes a generally concave or cup-shaped portion 30 and an elongated cylindrical journal portion 32 defining an aperture having an axis generally through the center of the cup-shaped portion 30. The torso 12 is provided with an aperture at the shoulder for mounting the first toy figure part 22. Each of the shoulder apertures includes a small semi-spherical inwardly directed flange 36 which engages the outside surface of the cup-shaped portion 30. A small annular, radially directed flange or tab 38 is provided around the outermost edge of the shoulder aperture adjacent the flange 36 to secure the first toy figure part 22 within the aperture by a snap fit behind the tabs 38. Although, in the embodiment described herein, the cup-shaped portions 30 are snap fit within the shoulder apertures, it is also contemplated that the first toy figure part be molded integrally with the torso 12.

The second toy figure parts 24 for the arms of the preferred embodiment are provided integrally with the arms 16. This second toy figure part 24 includes an outside, generally spherical or convex portion 40 having a generally cylindrical recess 42 therein. When the arms 16 are secured to the torso 12, the cylindrical recesses 42 are directed generally inwardly across the shoulder area of the torso 12.

The connecting member 26 secures the first and the second toy figure parts of the arms together. More particularly, referring to FIG. 7, the connecting member 26 includes an elongated shaft portion 48 which is secured at one end, in a non-perpendicular fashion, to a flexible disc-shaped flange portion 50. The flange 50 includes a circumscribing cylindrical flange 52 for attachment, as by glue, to the internal cylindrical wall 42 of the second toy figure part 24. The opposite end of the elongated shaft 48 has a tapered head 54 which is introduced through the journal 32 to the interior of the torso. As shown in FIG. 2, the diameter of the elongated shaft 48 is approximately equal to the internal diameter of the journal 32 so as to rotatably mount the arm 16 to the torso 12.

The joint structures 20 mounting the legs 18 to the torso 12 are described with reference to the bottom of FIG. 2, and FIGS. 5 and 8. Each of the leg joint structures 20 is somewhat similar to the arm joint structures 20 except that the component parts are slightly larger than those provided for in the arm joint structures. More particularly, referring to the bottom of FIG. 2, each leg joint structure generally includes a first, generally concave toy figure part, generally designated 62, disposed in the hip sockets of the torso 12, a second generally convex toy figure part, generally designated 64 (FIG. 5), formed integrally with the legs, and an intermediate connecting member, generally designated 68 (FIG. 8).

More particularly, referring to FIG. 5, the first toy figure parts 62 are secured to the torso 12 to maintain and secure the legs 18 to the torso. Each first toy figure part 62 includes a generally concave or cup-shaped portion 70 and an elongated cylindrical journal portion 72 having an axis generally through the center of the cup-shaped portion 70. The torso 12 is provided with a hip aperture at each hip on opposite sides of the bottom end of the torso 12. Each of the hip apertures includes a small partially spherical inwardly directed flange 76 which engages the outside surface of the cup-shaped portion 70. A small annular, radially directed flange or tab 78 is provided around the outermost edge of the aperture adjacent the flange 76 to secure the first toy figure part 62 within the hip aperture by a snap fit behind the tab 78. Although, in the embodient described herein, the cup-shaped portions 72 are snap fit within the apertures, it also is contemplated that the first toy figure part may be molded integrally with the torso 12.

Like the arm joint structures, the second toy figure parts of the hip or leg joint structures 20 are provided integrally with the legs. The second toy figure part 64 at the leg joints includes an outside generally spherical portion 80 having a generally cylindrical recess 82 therein. When the legs 18 are secured to the torso 12, the cylindrical recess 82 is directed generally inwardly toward the axis of the torso 12.

The connecting member 68 which secures the first and second toy figure parts of the legs together, includes an elongated shaft portion 84 which is secured at one end, in a non-perpendicular fashion, to a flexible, disc-shaped flange 86. Flange 86 includes a circumscribing cylindrical flange 88, extending in both directions therefrom. The cylindrical flange 88 is secured, as by glue, to the internal cylindrical surface of the cutout 82 in the second toy figure part secured to each leg. The elongated shaft portion 84 also is secured, as by glue, to the internal diameter of the journal 72 provided in the first toy figure part 62. In this manner, the mounting provided for the legs does not permit them to rotate as previously described for the arms.

The connecting members 26 and 68 are formed of highly flexible material, such as vinyl or the like, and are capable of being deformed by pressure on the arms and legs and returning to an undeformed configuration after the outside pressure or forces are terminated. Additionally, as described, the arms 16 are free to rotate about the axis of the journal 32 provided in the toy figure part 22. As shown in FIG. 1, the connecting members 26 and 68 are in a substantially undeformed configuration. A child or other user may move the arms or legs substantially in any direction while, also, if desired, rotating the arms 16. Movement of the arms 16 and legs 18 causes the connecting members 26 and 68 to deform or flex. More of this flexure is accommodated by deformation of the disc portions 50 and 86 of the connecting members 26 and 68, respectively. As the pressure on the arms or legs is released, the disc portions 50 and 86 return to their original configuration (FIG. 2) and thereby return the arms 16 and legs 18 to their normal positions as shown in FIG. 1.

Referring now to the top of FIG. 2 and FIG. 3, a modified form of joint structure is provided to secure the head 14 to the torso 12. More particularly, the torso 12 includes a generally spherical concave portion 92 molded or formed integrally therewith in the area between the shoulders. An aperture 94 is provided in the concave portion 92 for mounting the head 14. A concave plate 96 is provided interiorly and adjacent the aperture 94 for securing a connecting means, generally designated 98, within the aperture 94. The connecting means 98 comprises a flexible resilient member having enlarged spherical portions 102 on each end of a flexible connector portion 104.

The head 14 includes a complementary spherical convex portion 106 which mates with the portion 92 formed on the torso 12. An aperture is formed on the portion 106 of the head by an inwardly directed cylindrical wall 108. The cylindrical wall 108 is partially closed by a cylindrical flange 110. A second cylindrical portion 112 is inserted within the cylindrical wall 108 and is secured thereto as by glue, or the like. The end of the cylindrical wall 112 adjacent the convex portion 106 is open while the opposite end on the interior of the head, is closed by an integral disc 114. A hemispherical detent 116 is provided in the center of the disc 114 for locating one end 102 of the retaining means 98 in alignment with the aperture 94 in the torso. An opening 118 is provided at the bottom of the detent 116 to permit passage therethrough of the connecting means portion 104. In this manner, the head 14 is resiliently secured to the torso 12 so it can be rotated relative thereto and pivoted slightly to simulate the movement of a doll's head. The retaining disc 96 (FIG. 3) is slidable relative to the concave portion 92 so that the retaining means can move slightly until limited by the walls of the aperture 94. Unlike the joint structure 20 for the arms and legs, the joint structure 90 for the head permits the head to be moved and held at plural positions.

The foregoing detailed description has been given for clearness of understanding only and no unnecessary limitations should be understood therefrom as some modifications will be obvious to those skilled in the art.

We claim:

1. A joint structure for connecting parts of toy figures or the like, comprising:

a first toy figure part including a rounded portion at said joint, with an opening therein;

a second toy figure part having a complementary rounded portion at said joint; and connecting means disposed between said first and second toy figure parts at said joint, said connecting means comprising an elongated portion for insertion into the opening of said first toy figure part, means nonflexibly retaining said elongated portion in said opening, and a substantially flexible transverse flange portion on said elongated portion fixedly connected to the rounded portion of said second toy figure part to permit relative movement between said first and second toy figure parts by flexing said transverse portion.

2. The joint structure of claim 1 wherein the elongated portion of said connecting means is radially rotatably received within the opening formed in said first toy figure part.

3. The joint structure of claim 1 wherein the elongated portion of said connecting means is nonrotatably secured within the opening of said first toy figure part to prevent relative rotation of the second toy figure part with the first toy figure part.

4. The joint structure of claim 1 wherein the elongated portion of the connecting means includes an enlarged compressible head on the end thereof opposite the transverse portion for insertion through the opening in said first toy figure part to facilitate assembly and to retain said joint together when assembled.

5. The joint structure of claim 1 wherein said first toy figure part includes an elongated cylindrical journal at said opening for receiving said elongated portion of said connecting means to prevent radial flexing thereof.

6. A joint structure for connecting parts of toy figures, or the like, comprising:

a first toy figure part having a generally concave socket type portion at said joint, with an opening therethrough;

a second toy figure part having a complementary partially convex portion at said joint for positioning in said concave portion of said first part; and connecting means disposed between said first and second toy figure parts, said connecting means including an elongated shaft portion receivable in the opening of said first toy figure part at one end and including a generally disc-shaped flange at the other end thereof secured to the convex portion of said second toy figure part.

7. The joint structure of claim 6 wherein the convex portion of said second toy figure part includes a generally cylindrical opening therein, the axis of said cylindrical opening being generally in alignment with the opening in said first toy figure part, and said connecting means including a cylindrical flange circumscribing said disc shaped flange portion for engagement within the interior cylindrical surface of said cylindrical opening in the second toy figure part.

8. The joint structure of claim 7 including means for fixedly securing said cylindrical flange within said cylindrical opening.

9. The joint structure of claim 8 including means nonflexibility retaining said shaft in the opening of the concave portion of said first toy figure part.

10. The joint structure of claim 8 wherein the first toy figure part includes a generally cylindrical shaft journal formed in said opening for receiving the shaft portion of said connecting means.

11. The joint structure of claim 10 including means nonrotatably retaining said shaft in said cylindrical shaft journal.

12. The joint structure of claim 6 wherein said shaft portion of the connecting means extends generally perpendicular to said disc-shaped flange portion.

13. The joint structure of claim 6 wherein the axis of the shaft portion of said connecting means extends outwardly of said disc-shaped flange at an angle relative thereto.

* * * * *